US010327979B2

(12) United States Patent
Yoshida et al.

(10) Patent No.: US 10,327,979 B2
(45) Date of Patent: Jun. 25, 2019

(54) CHAIR-TYPE MASSAGE MACHINE

(71) Applicant: Fuji Medical Instruments Mfg. Co., Ltd., Osaka-shi, Osaka (JP)

(72) Inventors: Toshihisa Yoshida, Osaka (JP); Hironori Yasuda, Osaka (JP); Kentaro Ode, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 529 days.

(21) Appl. No.: 15/009,794

(22) Filed: Jan. 28, 2016

(65) Prior Publication Data

US 2017/0035647 A1 Feb. 9, 2017

(30) Foreign Application Priority Data

Aug. 3, 2015 (JP) ..... 2015-153365

(51) Int. Cl.
*A61H 9/00* (2006.01)
*A61H 37/00* (2006.01)

(52) U.S. Cl.
CPC ..... *A61H 9/0078* (2013.01); *A61H 37/00* (2013.01); *A61H 2201/0107* (2013.01); *A61H 2201/0149* (2013.01); *A61H 2201/0207* (2013.01); *A61H 2201/0228* (2013.01); *A61H 2201/0264* (2013.01); *A61H 2201/1207* (2013.01); *A61H 2201/1623* (2013.01); *A61H 2201/1635* (2013.01); *A61H 2201/5007* (2013.01); *A61H 2201/5082* (2013.01); *A61H 2205/06* (2013.01); *A61H 2205/081* (2013.01)

(58) Field of Classification Search
CPC ..... A61H 9/0078; A61H 2201/1635; A61H 2201/5082; A61H 37/00; A61H 2201/1623; A61H 1/00; A61F 2007/0018; A61F 2007/0024; A61F 2007/0029; A61F 7/007; A61F 7/08; A61F 7/00
USPC ..... 219/50, 200, 528; 297/180.11, 180.12; 601/15, 19, 46, 49
See application file for complete search history.

(56) References Cited

U.S. PATENT DOCUMENTS 5,613,730 A * 3/1997 Buie ..... B60N 2/5614 297/180.11
5,750,962 A * 5/1998 Hyatt ..... A61F 7/007 126/263.01
2010/0145245 A1* 6/2010 Chen ..... A61H 9/0078 601/149

FOREIGN PATENT DOCUMENTS

JP H10263034 * 3/1997 ..... A61H 7/00
JP 2000-350758 A 12/2000
JP 2006320630 * 5/2005 ..... A61F 7/08
JP 2007-312857 A 12/2007
JP 2008-206678 A 9/2008

OTHER PUBLICATIONS

JPO, Office Action dated Jan. 8, 2019 issued in corresponding Japanese Patent Application No. 2015-153365, Total 8 pages including English translation.

* cited by examiner

*Primary Examiner* — Michael J Tsai
*Assistant Examiner* — Zachary E Love
(74) *Attorney, Agent, or Firm* — Masuvalley & Partners

(57) ABSTRACT

A chair-type massage machine 100 has: a backrest portion 300 being capable of standing on a seat portion 200 and reclining against the seat portion 200; and at least one heater 850 disposed independently from a base portion 400 which is a lower part of the seat portion 200 through a cable 851.

11 Claims, 13 Drawing Sheets

CHAIR-TYPE MASSAGE MACHINE

This application claims priority under 35 U.S.C. § 119 to Japanese patent application Serial No. 2015-153365, filed Aug. 3, 2015 which is incorporated herein by reference in its entirety.

FIELD OF THE INVENTION

The present invention pertains to a chair-type massage machine.

BACKGROUND OF THE INVENTION

A chair-type massage machine in which a massage portion can be disposed at preferable places depending on a body type or preferences of a user is known.

The chair-type massage machine has a seat portion, and a backrest portion at which a first massage portion is provided. The chair type massage machine also has a second massage portion as well as a pad portion which is capable of adjusting its position against the seat portion or the backrest portion.

A backrest cushion for a massage machine is known. The backrest cushion has a possibility to give discomfort to a user because a kneading ball comes into contact with the back of a user as soon as the user sits on the massage machine.

The backrest cushion for a massage machine is provided at a massage machine which has a built-in massage action portion which massages the back portion of a user. The backrest cushion has a cushion portion which is provided at at least both of the right and left sides of the massage action portion and is capable of supporting the back of a user before the massage action portion comes into contact with the back of the user.

SUMMARY OF THE INVENTION

A chair-type massage machine according to one embodiment, includes:

a backrest portion being capable of standing on a seat portion and reclining against the seat portion; and at least one heater disposed independently from a base portion which is a lower part of the seat portion through a cable.

DETAILED DESCRIPTION OF THE PREFERRED EMBODIMENT

Embodiments of the present invention will be explained below with referring to the figures. The same or equivalent portions in the figures have the same reference numbers, and the explanations for them will not be repeated. Incidentally, in order to make the explanations clear, structures may be shown in a simple or schematic way or a part of components may be omitted in the figures which will be referred to below. Also, dimension ratios between the components shown in each figure do not necessarily show the actual dimension ratios.

First Embodiment

[Chair-Type Massage Machine 100]

Figure 1:
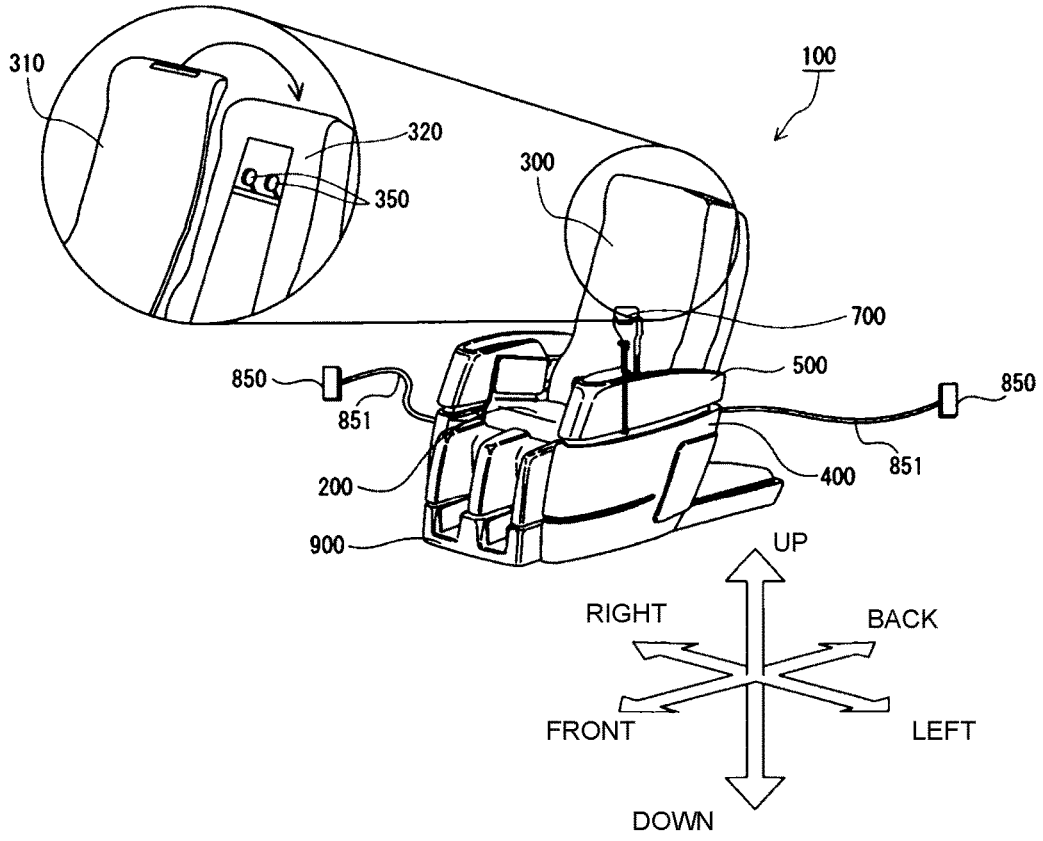
FIG. 1 is a perspective view showing the structure of a chair-type massage machine of an embodiment of the present invention.

FIG. 1 is a perspective view showing the structure of a chair-type massage machine 100 of an embodiment of the present invention. As shown in FIG. 1, the chair-type massage machine 100 of the first embodiment of the present invention is provided with a seat portion 200, a backrest portion 300, a base portion 400, an arm treatment portion 500, an operation portion 700, an independent heater 850, and a footrest portion 900.

Incidentally, in the following explanation, in the chair-type massage machine 100, the side where the backrest portion 300 is formed on the seat portion 200 is assumed to be the BACK as shown in FIG. 1. The opposite side of the BACK is assumed to be the FRONT. The left and right sides and the up and down sides are also assumed to be the LEFT, RIGHT, UP, and DOWN, respectively.

As shown in FIG. 1, the backrest portion 300 of the chair-type massage machine 100 supports the shoulders, the lower back, and the back of a person to be treated, and is formed so as to be able to stand and recline toward the front and back directions. Also, the backrest portion 300 has a built-in treatment member (a pair of treatment members) 350 which is movable toward the up and down directions along with a guide rail. The treatment member 350 is formed to be a pair of treatment members 350 so as to be able to do a variety of treatment movements such as kneading, tapping, and rolling.

The seat portion 200 of FIG. 1 is provided with at least one built-in inflation bag (air treatment portion) (not shown) which repeatedly expands, and the inflation bag treats the seat of a person to be treated, while supporting the seat of the person. Also, the footrest portion 900 is pivotally supported by the seat portion 200 and the front end of the base portion 400 so that the footrest portion 900, itself is pivotal. The footrest portion 900 has at least one inflation bag (not shown) which reputably expands, and the inflation bag treats the feet of a person to be treated.

Meanwhile, the arm treatment portions 500 are provided so as to stand at both the right side and the left side of the seat portion 200 of FIG. 1. The arm treatment portions 500 are provided with at least one built-in inflation bag (not shown) which repeatedly expands, and the inflation bag treats the arm of a person to be treated, while supporting the arm. At least one independent heated 850 is provided at arbitrary places through a cable 851 from the base portion 400. The detail of the independent heater 850 will be described later.

Figure 2:
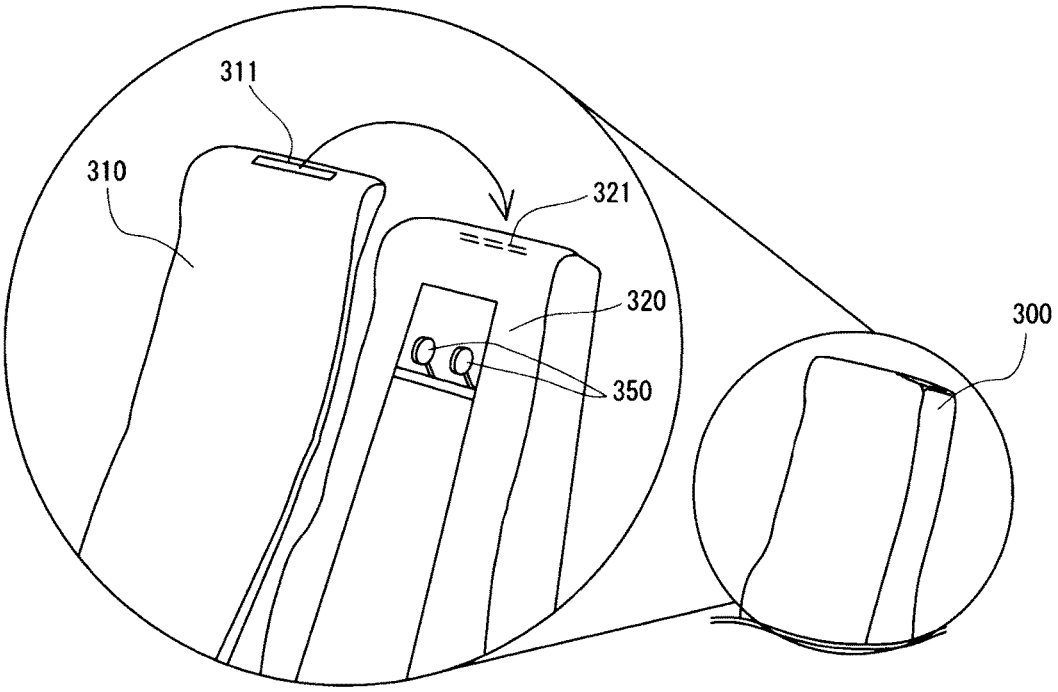
FIG. 2 is a schematic view showing an example in which a back pad is removed from a backrest portion of the chair-type massage machine.
Figure 3:
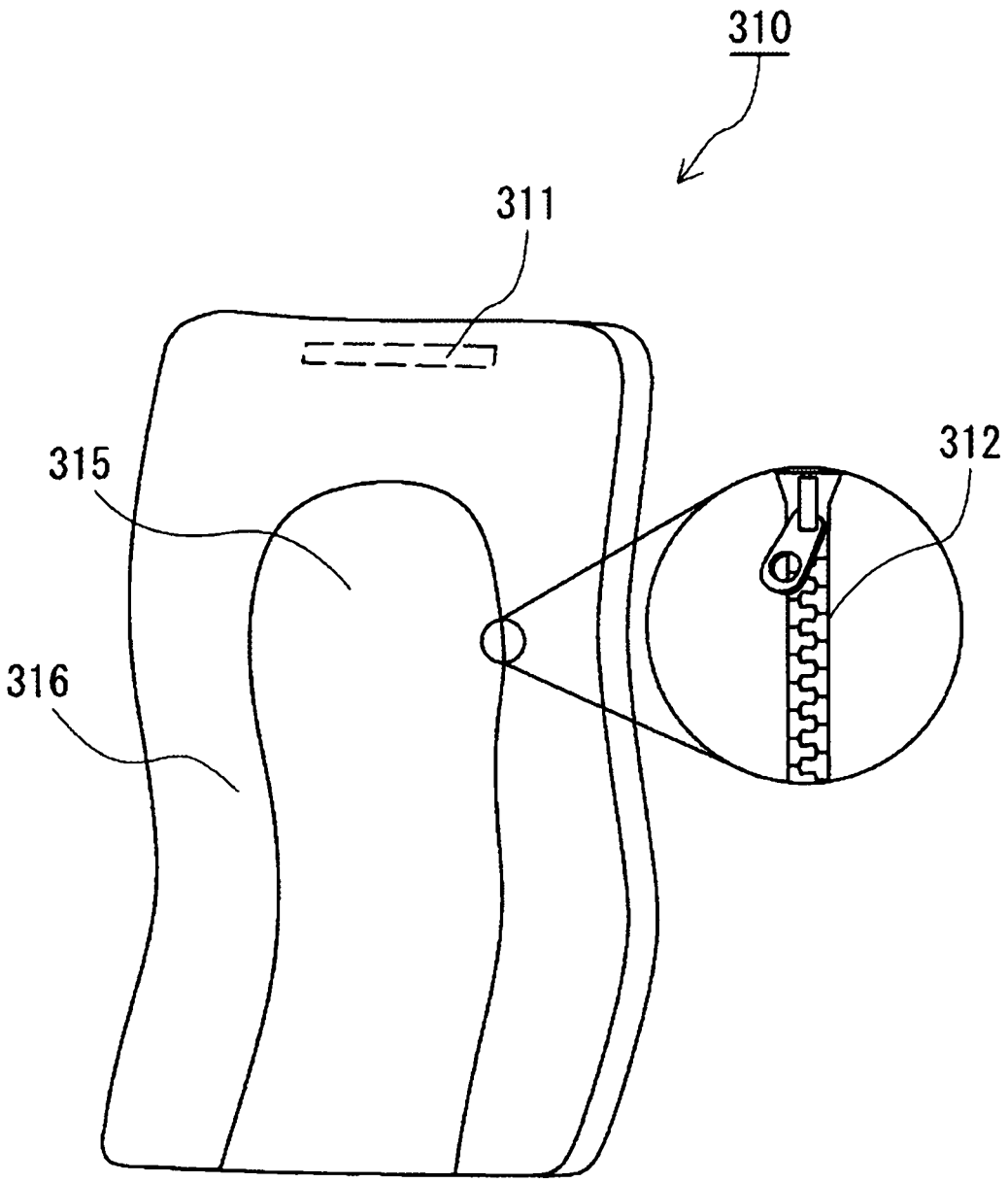
FIG. 3 shows a schematic view showing one example of a back pad.

Next, FIG. 2 is a schematic view showing an example in which a back pad 310 is removed from the backrest portion 300 of the chair-type massage machine 100. FIG. 3 is a schematic view showing one example of the back pad 310.

As shown in FIG. 2, the back pad 310 is provided so as to cover the front surface of a backrest material 320 of the backrest portion 300. A locking portion 311 provided at the rear surface of the back pad 310 is locked by a locking portion 321 provided at the upper end portion of the backrest material 320, and the back pad 310 is detachably attached. Incidentally, in FIG. 2, it is shown such that the treatment member (a pair of treatment members) 350 is visible when the back pad 310 is removed. However, this illustration is just to describe the structure. It is preferable to dispose a cloth material between the back pad 310 and the treatment member (a pair of treatment members) 350. It is especially preferable that the rear surface of the cloth material is made of durable materials on which the treatment member can easily slide, by considering the contact between the rear surface of the cloth material and the treatment member 350.

As shown in FIG. 3, the back pad 310 includes a locking portion 311, a zipper 312, a first pad portion 315, and a second pad portion 316. As shown in FIG. 3, the first pad portion 315 and the second pad portion 316 of the back pad 310 are made of a rectangle material with cushioning characteristic. Also, at least either the first pad portion 315 or the second pad portion 316 of the back pad 310 is provided with a heater.

In addition, the first pad portion 315 and the second pad portion 316 are formed to be able to engageable and separable with/from each other, by the zipper 312. As shown in FIG. 3, the zipper 312 is formed to be an inverted U-shape. As a result of this, the first pad portion 315 is formed to be a convex shape, and the second pad portion 316 is formed to be an inverted concave shape.

Figure 4:
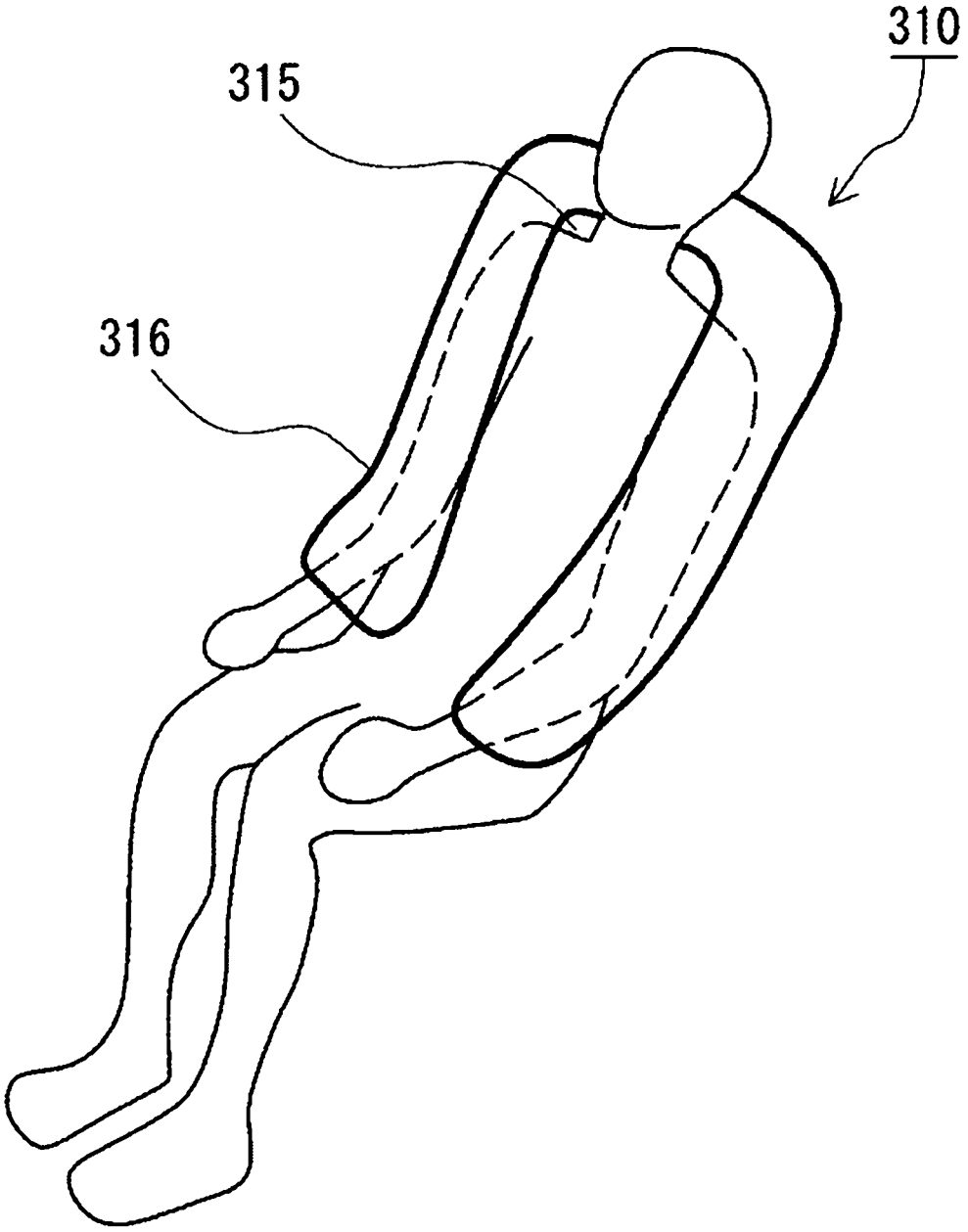
FIG. 4 is a schematic view showing one example in which the back pad of FIG. 3 is in use.

FIG. 4 is a schematic view showing one example in which the back pad 310 of FIG. 3 is in use. As shown in FIG. 4, the first pad portion 315 and the second pad portion 316 can be completely separated, or partially separated with leaving some part being engaged, by moving the zipper 312. As a result of this, the first pad portion 315 can be placed at the back side of a person to be treated, and the second pad portion 316 can be placed at the front side of the person to be treated, that is, the side of the shoulders, the arms, and the abdomen. Consequently, the first pad portion 315 of the back pad 310 is placed at the place where the treatment member 350 of the back pad 310 is supposed to be, and the sides of the shoulders, the arms, and the abdomen of the person to be treated are covered with the second pad 316 of the back pad 310.

(Another Example of Back Pad 310)

Figure 5:
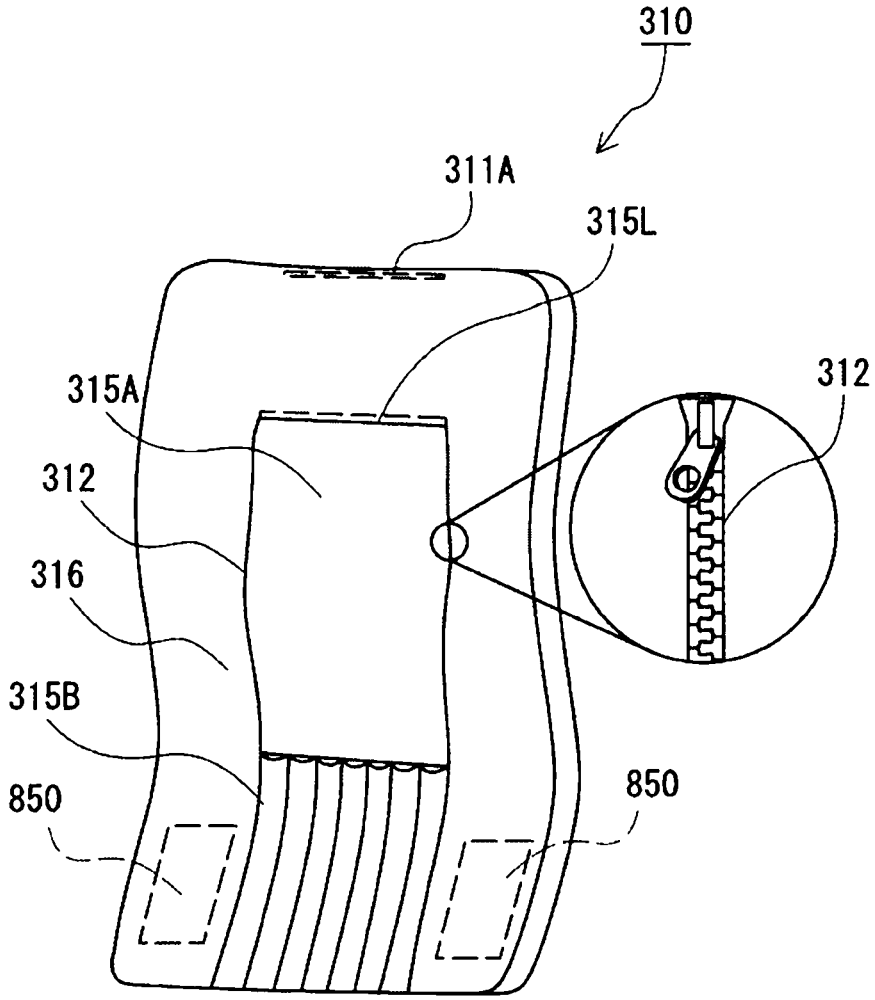
FIG. 5 is a schematic view showing another example of a back pad.
Figure 6:
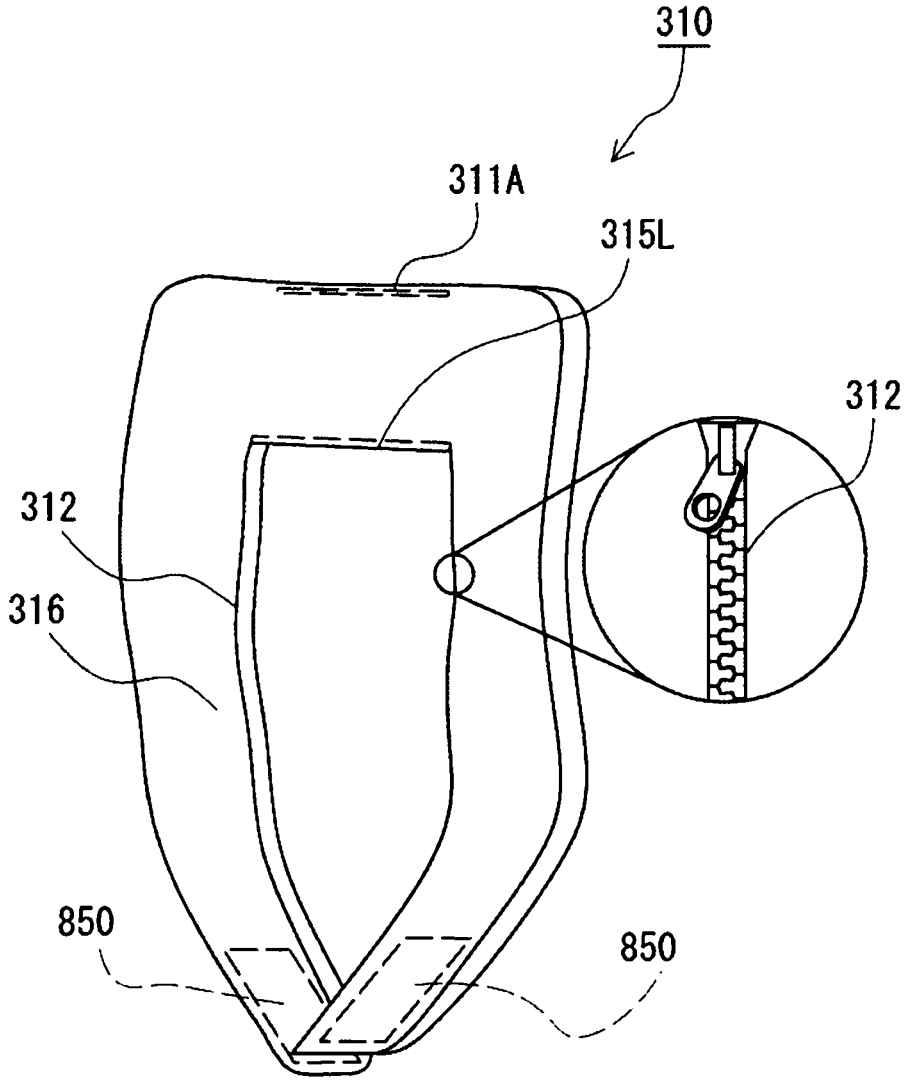
FIG. 6 is a schematic view showing an example of the use of a back pad.

FIG. 5 is a schematic view showing another example of a back pad 310. FIG. 6 is a schematic view showing an example of the use of the back pad 310.

As shown in FIG. 5, the back pad 310 has a zipper 311A, a zipper 312, a first cloth portion 315A, a hook and loop fastener 315L, a first pad portion 315B, and a second pad portion 316. Also, as shown in FIG. 5, an independent heater 850, which will be described later, is received in the inner side (the rear surface of FIG. 5, the broken line) of the second pad portion 316. Incidentally, a power cable of the independent heater 850 is connected to the base portion 400 through the zipper 311A side and the backrest portion 300.

Next, the zipper 312 and the hook and loop fastener 315L are formed so as to have a rectangle shape. Also, the first cloth portion 315A is made of a cloth material, and the first pad portion 315B is made of a material with cushion characteristic. The material with cushion characteristic is, for example, urethane and the like.

In the back pad 310 of FIG. 5, as the same manner as FIG. 3, the first cloth portion 315A and the first pad portion 315B can be completely removed with leaving the second pad portion 316, by detaching the hook and loop fastener 315L as well as moving the zipper 312. As a result of this, the first pad portion 315 is completely removed, and the second pad portion 316 can be placed at the front side, that is, the side of the abdomen of a person to be treated. Specifically, as shown in FIG. 6, it is possible to cross the independent heaters 850 provided at the lower parts of the second pad portion 316, and the abdomen of the person to be treated can be surely warmed.

Figure 7:
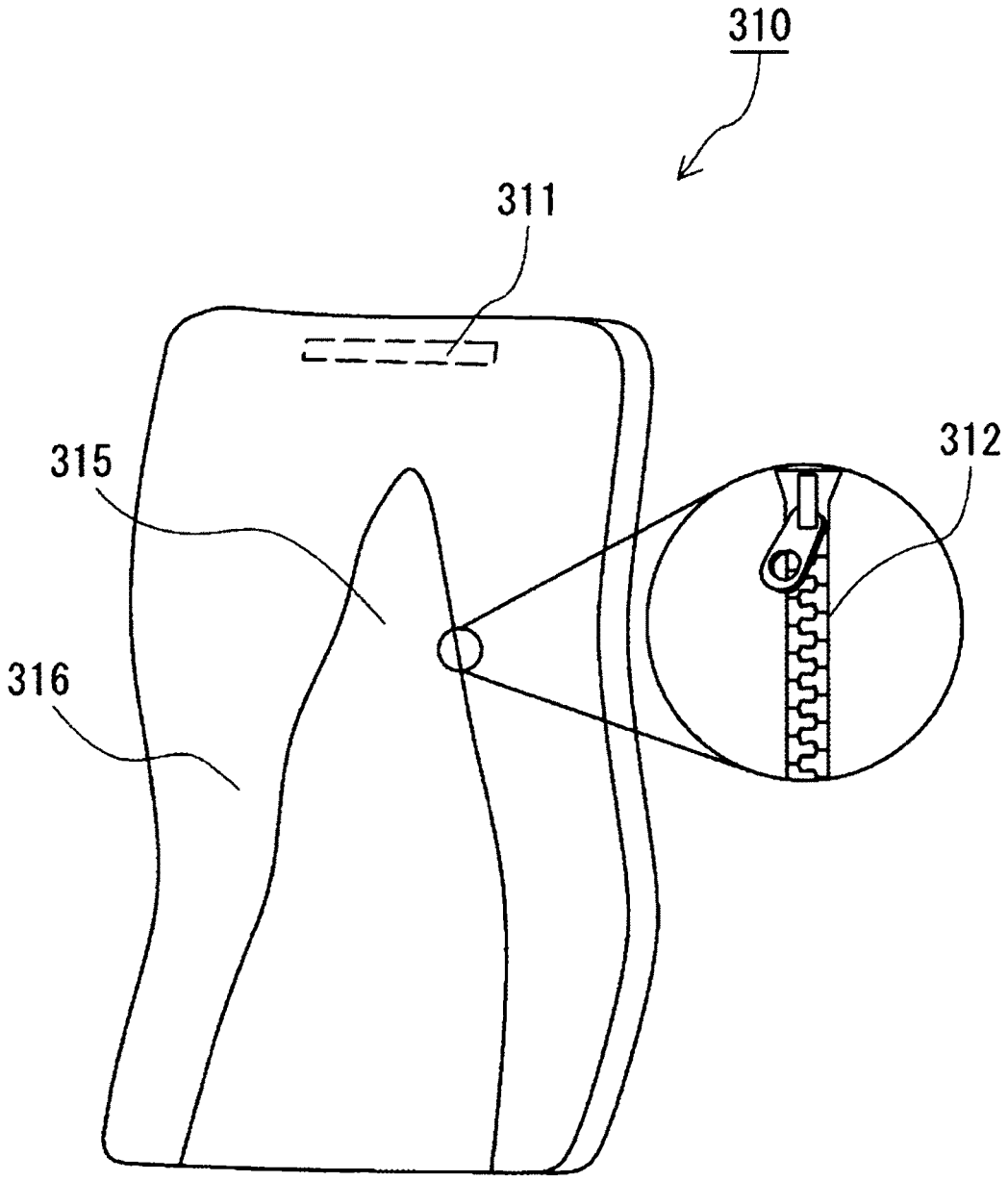
FIG. 7 is a schematic view showing one of the other examples of a back pad

FIG. 7 is a schematic view showing one of the other examples of a back pad 310. As shown in FIG. 7, the back pad 310 has a zipper 312, a first pad portion 315, and a second pad portion 316.

The zipper 312 of FIG. 7 is formed to be an inverted V-shape. As a result of this, the first pad portion 315 is formed to be a triangle shape, and the second pad portion 316 is formed to be a shape where the triangle shape is removed from a rectangle shape.

In the back pad 310 of FIG. 7, as the same manner as FIG. 3, the first pad portion 315 and the second pad portion 316 can be completely separated or partially separated with leaving some part being engaged, by moving the zipper 312. As a result of this, the first pad portion 315 can be placed at the back side of a person to be treated, and the second pad portion 316 can be placed at the front side of the person to be treated, that is, the side of the abdomen.

Figure 8:
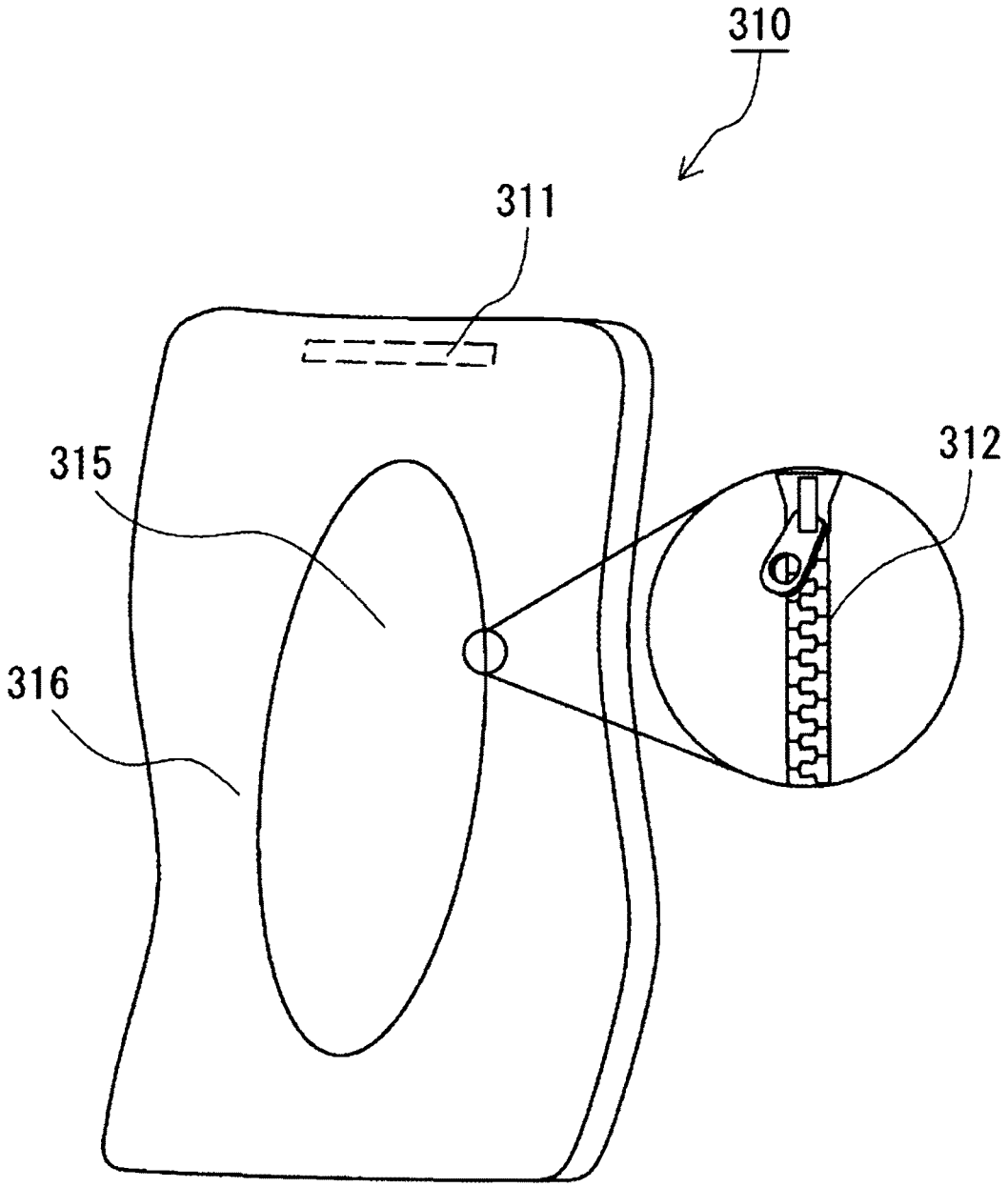
FIG. 8 is a schematic view further showing one of the other examples of the back pad.

FIG. 8 is a schematic view showing one of the other examples of a back pad 310. As shown in FIG. 8, the back pad 310 has a zipper 312, a first pad portion 315, and a second pad portion 316.

The zipper 312 of FIG. 8 is formed to be an oval shape. As a result of this, the first pad portion 315 is formed to be an oval shape, and the second pad portion 316 is formed to be a shape where the oval shape is removed from a rectangle shape.

In the back pad 310 of FIG. 8, as the same manner as FIG. 3, the first pad portion 315 and the second pad portion 316 can be separated by moving the zipper 312. As a result of this, the first pad portion 315 can be placed at the back side of a person to be treated, and the second pad portion 316 can be placed at the front side of the person to be treated, that is, the side of the abdomen.

Figure 9:
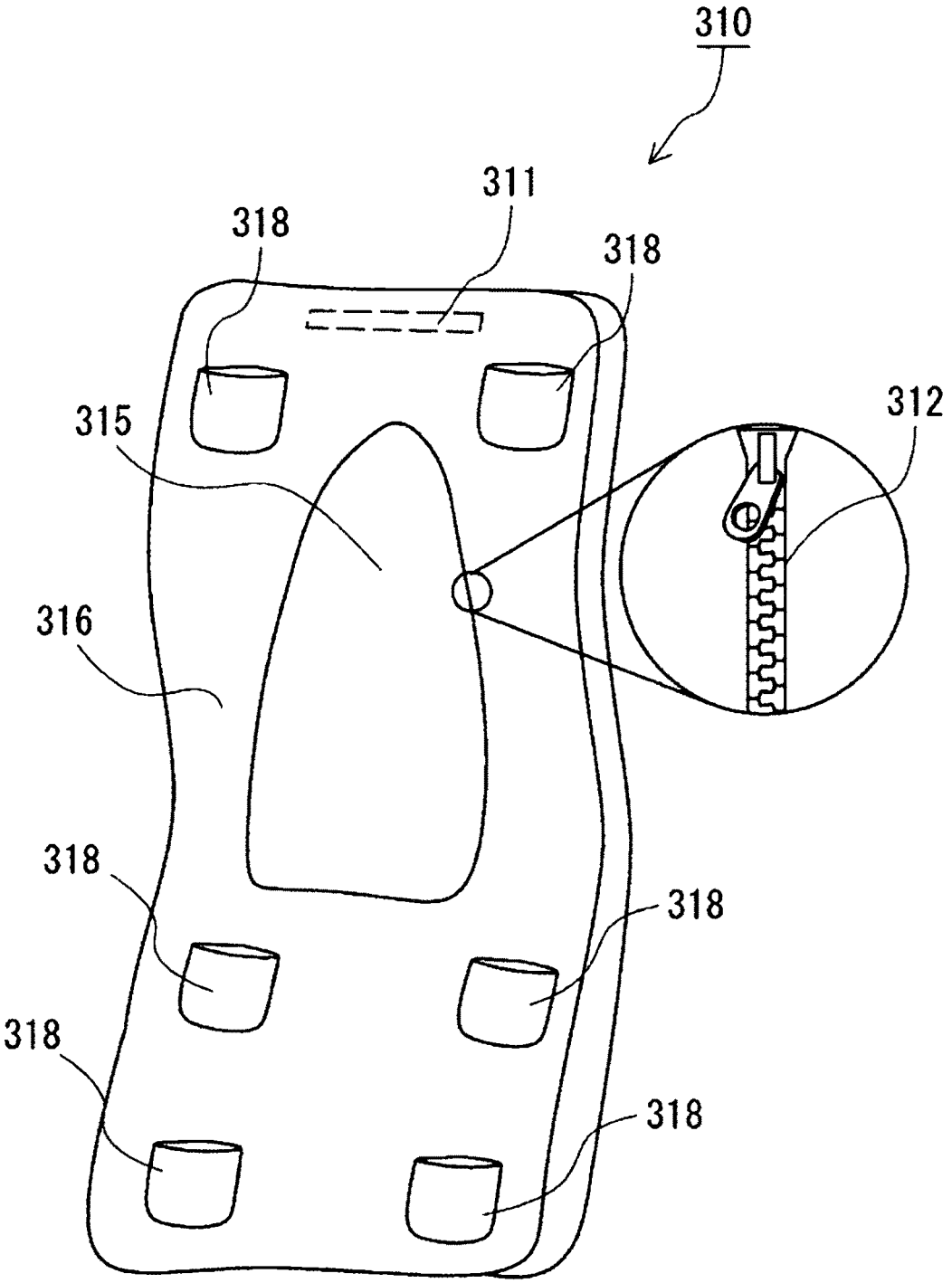
FIG. 9 is a schematic view further showing one of the other examples of a back pad.
Figure 10:
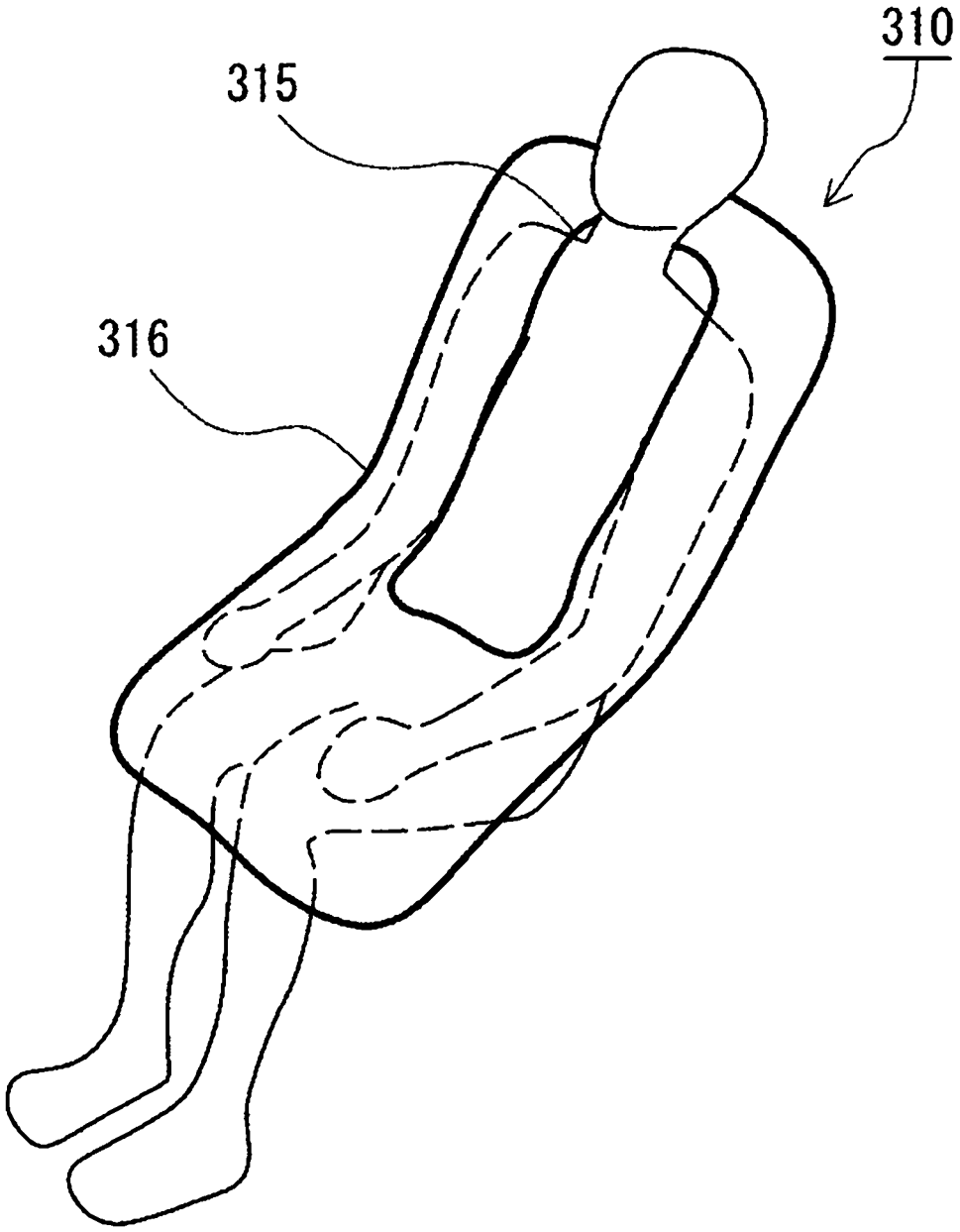
FIG. 10 is a schematic view showing one example in which the back pad of FIG. 9 is being used by a person to be treated.

FIG. 9 is a schematic view further showing one of the other examples of a back pad 310. FIG. 10 is a schematic view showing one example in which the back pad 310 of FIG. 9 is being used by a person to be treated.

As shown in FIG. 9, the back pad 310 has a zipper 312, a first pad portion 315, and a second pad portion 316. Also, at the second pad portion 316 of FIG. 9, a heater bag 318 being capable of receiving an independent heater 850 is provided. Incidentally, in FIG. 9, the heater bag 318 is provided at the surface of the second pad portion 316; however, the heater bag 318 can be provided at the first pad portion 315 or the rear surface of the second pad portion 316.

Also, the independent heater 850 can be received by the surface or the rear surface of the second pad portion 316 by attaching the independent heater 850 on them.

The zipper 312 of FIG. 9 is formed to be an isosceles triangle shape. As a result of this, the first pad portion 315 is formed to be an isosceles triangle shape, and the second pad portion 316 is formed to be a shape where the isosceles triangle shape is removed from a rectangle shape.

In the back pad 310 of FIG. 9, as the same manner as FIG. 3, the first pad portion 315 and the second pad portion 316 can be completely separated or partially separated with leaving some part being engaged, by moving the zipper 312. As a result of this, the first pad portion 315 can be placed at the back side of a person to be treated, and the second pad portion 316 can be placed at the front side of the person to be treated, that is, the side of the abdomen. It should be noted that the back pad 310 of FIG. 9 has the longer length than the total length of the seat portion 200 and the backrest portion 300. Therefore, as shown in FIG. 10, a person to be treated can be covered with the back pad 310 up to the knees. Consequently, even if a person to be treated using the chair-type massage machine is female, there is no need to additionally put a blanket and the like on her knees.

Also, in the embodiment described above, each independent heater 850 can be received in each heater bag 318. Therefore, it is possible to put the independent heater 850 at places depending on preferences of a person to be treated, and the person to be treated can freely warm up the places where the person wants to be warmed.

Even though only FIG. 9 has the heater bag 318 in its illustration, the heater bag 318 is not limited to FIG. 9. It is also possible to provide the heater bag 318 at arbitrary places of the back pad 310 of FIGS. 3 through 8. Incidentally, in the present embodiment, the heater bag 318 is described to be provided; however, the heater bag 318 is not the only means. Other arbitrary structures which are attachable and detachable with/from each other can be used, such as a hook and loop fastener (VELCRO®), a button, and the like. As a result of this, it is possible to freely put the independent heater 850 at arbitrary places of the back pad 310.

(Independent Heater)

Figure 11:
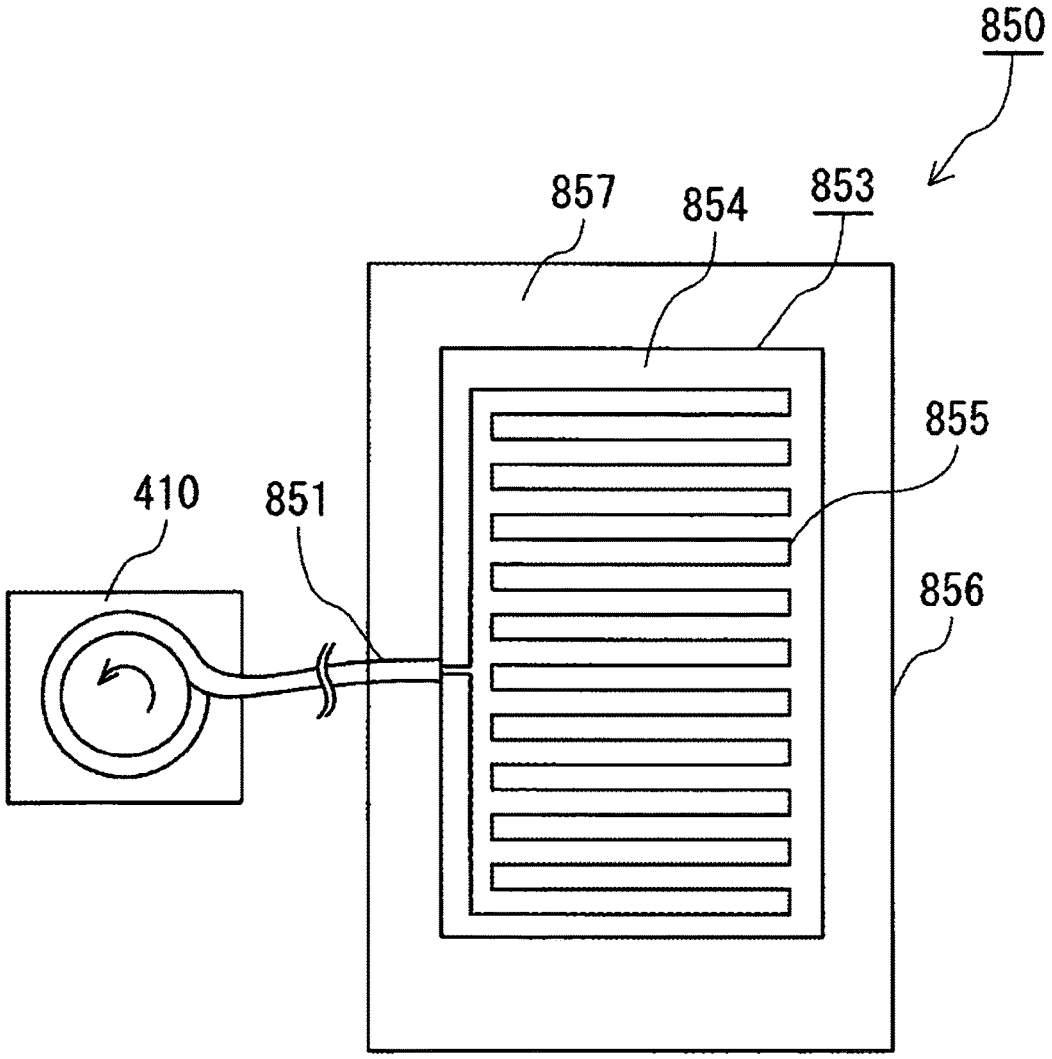
FIG. 11 is a schematic view showing one example of an independent heater and a cable.

FIG. 11 is a schematic view showing one example of an independent heater 850 and a cable 851.

As shown in FIG. 1, in the present embodiment, the independent heater 850 is formed through the cable 851 from the base portion 400. Also, in the present embodiment, two independent heaters are provided; however, the number of the independent heater is not limited to two, and the arbitrary number of independent heaters 850, such as the number of one, three, four, and the like, can be provided.

As shown in FIG. 11, the independent heater 850 has a heater body 853 which is made of a rectangle-shaped sheet material, a cable 851 which supplies the power to the heater body 853, and a protective material 857 which protects the heater body 853 and the cable 851.

Incidentally, a locking portion 856 may be provided at a part of the protective material 857 of FIG. 11. In the case where the heater bag 318 of FIG. 9 is provided, the locking portion 856 is not needed to be provided. The locking portion 856 is described as an example; however, the locking portion 856 is not the only means. Other arbitrary structures which are attachable and detachable can be used, such as a hook and loop fastener, a button, and the like. Also, in the case where the locking portion 856 is a hook and loop fastener, the locking portion 856 can be attached at an arbitrary places of the back pad 310.

The protective material 857 is made of a material which has mechanical strength and stain-resistance. For example, the protective material 857 is made of a material of a multiple structure having vinyl chloride resin (hereinafter, referred to be as PVC), nonwoven fabric, and the like.

Also, in the heater body 853, a heater wire 855 is disposed meanderingly on a seat material 854 which is composed of mainly metallic elements. It is preferable that the metallic elements are composed of aluminum and the like which have high thermal conductivity. Also, it is possible to have a built-in diffusion sheet (not shown) for entirely diffusing the heat from the heater wire 855.

Incidentally, in the present embodiment, it is described that a control portion of the independent heater 850 is built-in in the base portion 400 of the body of the chair-type massage machine 100; however, the control portion is not limited to this manner and it is possible that each independent heater 850 has each control portion. Also, the independent heater 850 may have a built-in sensor. As a result of this, a user can surely control the temperature of each independent heater 850 by operating the operation portion 700.

Next, the cable 851 is formed to be able to be reeled by a reeling device 410 which is provided at the base portion 400. Incidentally, in the present embodiment, the heater wire 855 meanderingly disposed is described as an example; however, the heater wire is not only the means and other arbitrary thermal power generations may be used, such as a surface heater and the like.

Figure 12:
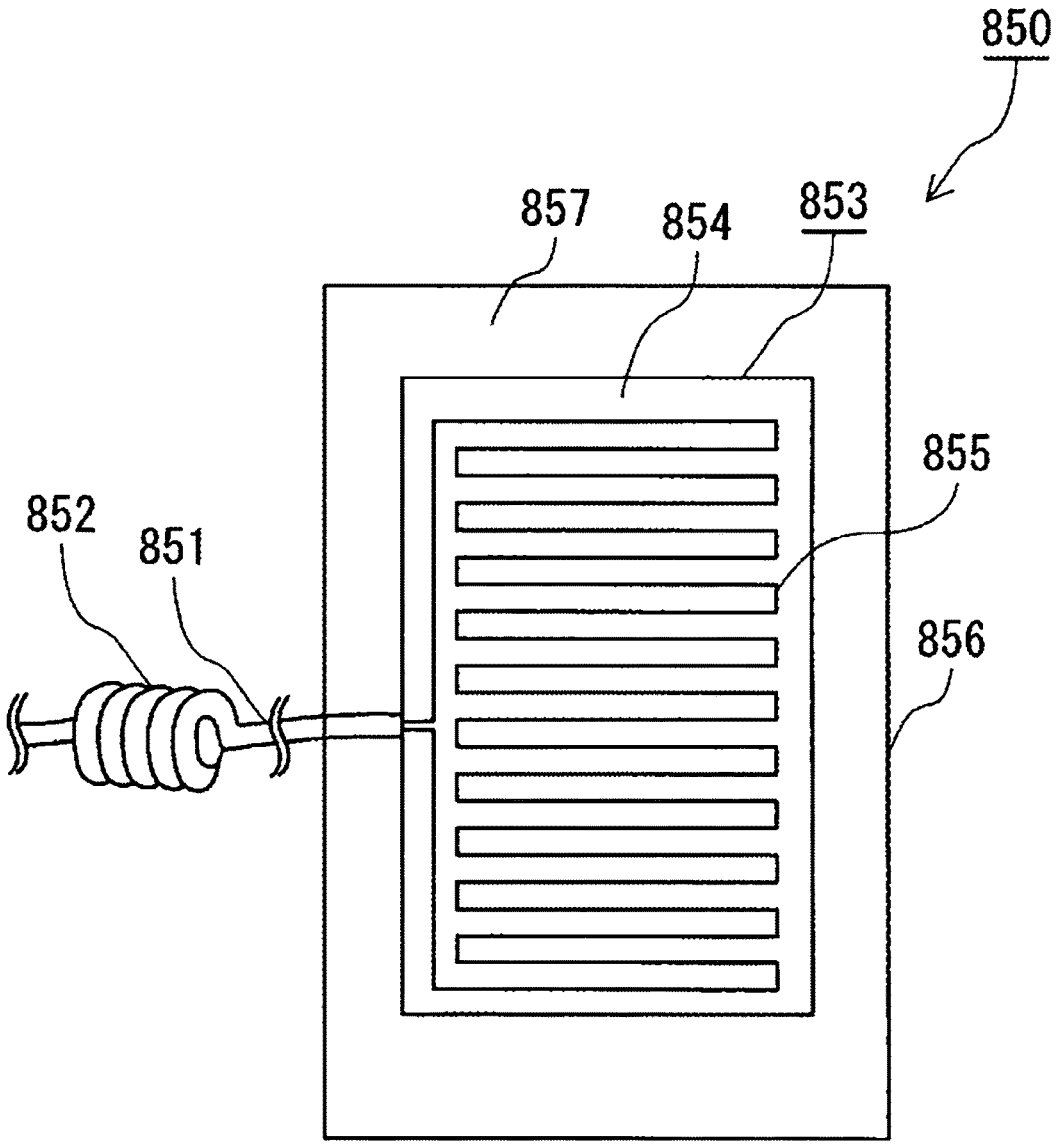
FIG. 12 is a schematic view showing another example of an independent heater and a cable.

Next, FIG. 12 is a schematic view showing another example of an independent heater 850 and a cable 851.

Regarding FIG. 12, only different points from FIG. 11 will be explained. The independent heater 850 of FIG. 12 is composed of the same elements as the independent heater 850 of FIG. 11. In FIG. 11, the reeling device 410 is used. In FIG. 12, a cable 852 which has an extensible shape is provided. The cable 852 has the shape where the cable 851 has been reeled. As a result of this, the length of the cable is freely adjustable.

Figure 13:
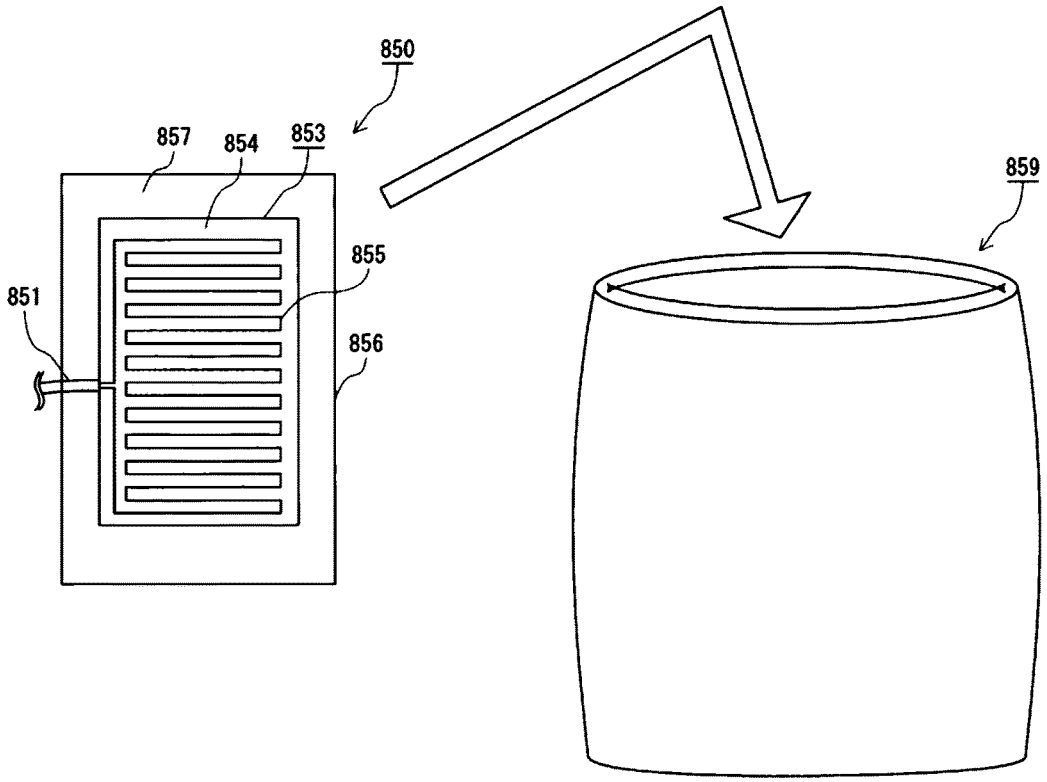
FIG. 13 is a schematic view showing one of the other examples of an independent heater and a cable.

Also, FIG. 13 is a schematic view showing another example of an independent heater 850 and a cable 851.

Regarding FIG. 13, only different points from FIGS. 11 and 12 will be explained. The independent heater 850 of FIG. 13 is received in a bag 859. It is preferable that the bag 859 has cushion characteristic, thereby allowing the independent heater 850 to be freely placed at places where a person to be treated desires the independent heater to be.

As described above, the shape of the divided structure of the back pad 310 is described to have a circle shape, a rectangle shape, an oval shape, an inverted U-shape, and an inverted V-shape as an example. However, the shape is not limited to these. It is possible to divide the back pad into a range in which a pair of treatment members transfer and the other range in which a pair of treatment members do not transfer. As a result of this, in the case when a person to be treated wants to feel stronger kneading, it is possible to shorten the distance between the person to be treated and a pair of treatment members 350 by removing the first pad portion 315 (including the first cloth portion 315A and the first pad portion 315B) from the back pad 310.

Also, the back pad 310 is supposed to be able to be taken out from the locking portion 311; however, the back pad 310 is not limited to this way, and the upper end of the back pad 310 may be attached to the upper end of the backrest portion 300.

In addition, it is possible to use arbitrary heaters as the independent heater 850, such as a PTC heater, a film heater having the PTC characteristic, a ribbon heater having the PTC characteristic, a portable heater, and the like.

As described above, at least one independent heater 850 disposed independently from the base portion 400 through the cable 851 can be freely placed at any places. As a result of this, the independent heater 850 can be placed at places depending on a user's preferences.

Also, the independent heater 850 may be received in the heater bag 318 of the back pad 310. Further, since the independent heater 850 may be locked by the locking portion of the back pad 310, the independent heater 850 can be placed at any places of the entire of the back pad 310. As a result of this, the independent heater 850 can be placed at places depending on a user's preferences. In addition, since the reeling device 410 is formed inside the seat portion 200 or the base portion 400, it is possible to easily reel the cable 851.

Also, in the case when the cable 852 is used, the cable 852 has a shape or a material which allows the length of the cable 851 to be adjustable. It is possible to prevent the cable 851 from tangling. As a result of this, it is possible to easily change the length of the cable 851, thereby easily using the independent heater 850.

Also, it is possible to control each temperature of the at least one independent heater by the operation portion 700. As a result of this, it is possible to control the temperature depending on a user's preferences.

Also, one end of the back pad 310 is locked by the upper part of the backrest material 320 of the backrest portion 300. In addition, a divided structure is formed in a part of the back pad 310. As a result of this, a part having a heat pad function and the other part having the function of the back pad 310 is divided by the divided structure. Therefore, there is no need to provide an additional heat pad on the back pad 310. Also, the distance between the back of a user and the treatment member 350 can be only the thickness of the back pad 310, and it is possible to enhance a massage effect by the treatment member 350. Also, it is possible to reduce the costs.

Also, the back pad 310 has a built-in independent heater 850. Therefore, by the divided structure, it is possible to place the heat pad function at either the back side or the abdomen side of a user, or both of the sides depending on the user's preferences.

The shape of the divided structure of the back pad 310 has any one of a circle shape, an oval shape, an inverted U-shape, and an inverted V-shape. Therefore, it is possible for a user to put the head out of the circle shape or the oval shape, thereby placing the back pad at the abdomen portion of the user. Also, the back pad 310 shown in FIG. 9 is formed to have the longer length than the total of the backrest portion 300 and the seat portion 200. It is possible to cover a user with the back pad 310 up to near the knees by dividing a part of the back pad 310. As a result of this, even if the user wears a skirt and the like, it is possible to cover the user up to near the knees.

(Correspondence Relation Between Each Portion in Embodiments and Each Component of Claims)

In the present invention, the chair-type massage machine 100 corresponds to "a chair-type massage machine." The seat portion 200 corresponds to "a seat portion." The backrest portion 300 corresponds to "a backrest portion." The cable 851 corresponds to "a cable." The independent heater 850 corresponds to "at least one heater, and a sheet heater." The back pad 310 corresponds to "a back pad." The heater bag 318 corresponds to "a receiving portion." The reeling device 410 corresponds to "a reeling portion." The cable 852 corresponds to "a shape or material which allows the length of the cable itself to be adjustable." The operation portion 700 corresponds to "a temperature controlling portion." The back pad 310, the zipper 312, the first pad portion 315, and the second pad portion 316 correspond to "a divided structure."

The preferable embodiments of the present invention are described above; however, the present invention is not limited to these. It should be understood that there are other various embodiments without deviating from the spirit and the scope of the present invention. Also, the effects by the structure of the present invention are described in the present embodiments. However, these effects are only examples. The present invention is not limited by these.

It should be noted that, recently, a general chair-type massage machine has a heater sheet placed to overlap with a back pad. However, recently, it is desired to thin the thickness of the back pad and the heater sheet in order to facilitate conveying the power of the treatment member.

According to one embodiment of the invention it is possible to provide a chair-type massage machine in which a back pad and a heater are integrated as well as the thickness of the back pad and the heater can be thinned down.

In addition, it is possible to place the at least one heater disposed independently from the base portion through the cable, at wherever a user wants. As a result of this, the heater can be placed depending on preferences of the user.

(2) A chair-type massage machine according to the one embodiment may have the heater having a sheet heater; the backrest portion including a back pad; and the back pad including a receiving portion being capable of receiving the sheet heater.

In this case, the sheet heater can be received in the receiving portion of the back pad. As a result of this, the sheet heater can be placed at a position where the receiving portion is formed.

(3) A chair-type massage machine according to the one embodiment may have the heater having a sheet heater; the backrest portion including a back pad; and the back pad including a locking portion being capable of locking the sheet heater.

In this case, the sheet heater can be locked by the locking portion of the back pad. For example, in the case where the lock portion is formed at all over the back pad, the heater can be placed at any position of all over the back pad. As a result of this, the sheet heater can be placed at a user's preferable place.

(4) A chair-type massage machine according to the one embodiment may further include a temperature controlling portion for controlling a temperature of each of the at least one heater.

In this case, each temperature of the at least one heater can be controlled by the temperature controlling portion. As a result of this, it is possible to control the temperature depending on preferences of a user.

(5) A chair-type massage machine according to a second embodiment includes:

a backrest portion being capable of standing on a seat portion and reclining against the seat portion, wherein the backrest includes a back pad; and one end of the back pad is locked by or attached to an upper part of the backrest portion, while a divided structure is formed in a part of the back pad.

In this case, one end of the back pad is locked by the upper part of the backrest portion. Also, the divided structure is formed in a part of the back pad. As a result of these, a portion with a heat pad function and the other portion with a back pad function can be divided by the divided structure. Therefore, there is no need to provide an additional heat pad on the back pad. It is also possible to reduce the distance between the back portion of a user and the treatment member, thereby being able to increase a massage effect by the treatment member. In addition, since there is no need to provide an additional heat pad, it is possible to realize reducing costs.

(6) A chair-type massage machine according to the second embodiment may have the back pad having a built-in sheet heater.

In this case, since the back pad has the built-in sheet heater, due to the divided structure, a heat pad function can be placed at either the back side or the abdomen side of a user, or at both of the sides, depending on preferences of the user.

(7) A chair-type massage machines according to the second embodiment may have the divided structure which is formed so as to have any one of a circle shape, a rectangle shape, an oval shape, an inverted U-shape, and an inverted V-shape.

In this case, the shape of the divided structure is formed so as to have any one of a circle shape, a rectangle shape, an oval shape, an inverted U-shape, and an inverted V-shape. Therefore, it is possible for a user to put the user's head portion out of the circle shape or the oval shape. Consequently, it is possible to put the back pad at the abdomen side of the user.

(8) A chair-type massage machine according to the second embodiment may have the divided structure which includes any one of a locking structure, a zipper, and a hook and loop fastener (Velcro).

In this case, since the divided structure includes any one of a locking structure, a zipper, and a hook and loop fastener (Velcro), it is possible to easily divide and integrate the portion with the heat pad function and the other portion with the back pad function.

(9) A chair-type massage machine according to the second embodiment may further include at least one heater disposed independently from a base portion through a cable, wherein the back pad includes a receiving portion for receiving the at least one heater or a locking portion for locking the at least one heater.

In this case, in the case where the back pad includes the receiving portion, the heater can be received in the receiving portion. In the case where the back pad includes the locking portion, the heater can be locked by the locking portion.

(A) A chair-type massage machine according to one embodiment of the present invention may have a reeling portion inside the base portion. The reeling portion is capable of reeling the cable.

In this case, since the reeling portion is formed inside the base portion, it is possible to easily reel the cable. As a result of this, the cable is easily stored, thereby facilitating the use of the heater.

(B) In a chair-type massage machine according to one embodiment of the present invention, the cable may have a shape or material which allows the length of the cable itself to be adjustable.

In this case, the cable has the shape which allows the length of the cable itself to be adjustable, or the cable is formed by the material which allows the length of the cable itself to be adjustable. Therefore, it is possible to prevent the cable from tangling. As a result of this, it is possible to easily adjust the length of the cable, thereby facilitating the use of the heater.

(C) In a chair-type massage machine according to one embodiment of the present invention, the back pad may be formed so as to have the longer length than the total length of the backrest portion and the seat portion.

In this case, the back pad is formed so as to have the longer length than the total length of the backrest portion and the seat portion. Therefore, it is possible to cover a user nearly up to the knees by dividing a part of the back pad portion. As a result of this, even when a user wears a skirt and the like, it is possible to cover the user nearly up to the knees.

What is claimed is:

1. A massage machine comprising:

a backrest portion being capable of standing on a seat portion and reclining against the seat portion; the backrest portion having a backrest material provided with a treatment member on front surface thereof; a base portion provided at a lower portion of the seat portion; at least one heater disposed independently from a base portion through a cable; and a back pad which is provided so as to cover the front surface of the backrest material, the back pad having a first pad portion and a second pad portion separably joined by a zipper, wherein the second pad portion is configured to be completely separated from the first pad portion and also configured to be partially separated with leaving a part from the first pad portion joined to the second pad portion, and wherein when the second pad portion is separated from the first pad portion, the first pad portion is configured to be placed at the front side of the backrest portion corresponding to a back side of a person to be treated sitting on the massage machine, and the second pad portion is configured to be placed at the front side of the backrest portion so as to cover at least a shoulder of the person to be treated;

wherein the second pad portion is formed in an inverted U shape in a front view including an upper horizontal portion and arm portions vertically provided downward from both end portions of the upper horizontal portion, and the first pad portion is formed in a shape to be disposed in an opening portion formed in the second pad portion.

2. The massage machine according to claim 1, wherein the heater comprises a sheet heater; and the back pad includes a receiving portion being capable of receiving the sheet heater.

3. The massage machine according to claim 1, wherein the first pad portion is placed at the front side of the backrest portion so as to cover the treatment member.

4. The massage machine according to claim 1, wherein the heater is disposed on back side or inside of the second pad portion.

5. The massage machine according to claim 1, wherein a first engaging portion is provided on the back surface of the back pad, and the backrest member has a second engaging portion on the upper end portion thereof which is engageable with the first engaging portion.

6. The massage machine according to claim 1, wherein the first pad portion and the second pad portion are made of a material with cushion characteristic.

7. The massage machine according to claim 1, wherein the second pad portion is configured to be placed at the front side of the back portion so as to cover shoulder, arm, and abdomen of the person to be treated.

8. A massaging machine comprising:

a seat portion;

a backrest portion being capable of standing on the seat portion and reclining against the seat portion, the backrest portion having a backrest material provided with a treatment member on front surface thereof;

a base portion provided at a lower portion of the seat portion;

at least one heater disposed independently from the base portion through a cable;

wherein the massaging machine further comprising:

a back pad which is provided so as to cover the front surface of the backrest material, the back pad having a first pad portion and a second pad portion separably joined by a zipper, wherein the second pad includes a receiving portion for receiving a heater or a locking portion for locking the heater, and wherein when the second pad portion is separated from the first pad portion, the second pad portion is configured to be placed at the front side of the backrest portion so as to cover at least shoulder of a person to be treated;

wherein the second pad portion is formed in an inverted U shape in a front view including an upper horizontal portion and arm portions vertically provided downward from both end portions of the upper horizontal portion, and the first pad portion is formed in a shape to be disposed in an opening portion formed in the second pad portion.

9. The massage machine according to claim 8, wherein the heater comprises a sheet heater.

10. A massage machine comprising:

a backrest portion being capable of standing on a seat portion and reclining against the seat portion; the backrest portion having a backrest material provided with a treatment member on front surface thereof; a base portion provided at a lower portion of the seat portion; at least one heater disposed independently from a base portion through a cable; and a back pad which is provided so as to cover the front surface of the backrest material, the back pad having a first pad portion and a second pad portion separably joined by a zipper, wherein the second pad portion is configured to be completely separated from the first pad portion and also configured to be partially separated with leaving a part from the first pad portion joined to the second pad portion, and wherein when the second pad portion is separated from the first pad portion, the first pad portion is configured to be placed at the front side of the backrest portion corresponding to a back side of a person to be treated sitting on the massage machine, and the second pad portion is configured to be placed at the front side of the backrest portion so as to cover at least a shoulder of the person to be treated;

wherein the second pad portion has an opening portion, and the first pad portion is formed in a shape to be disposed in the opening portion formed in the second pad portion.

11. A massaging machine comprising:

a seat portion;

a backrest portion being capable of standing on the seat portion and reclining against the seat portion, the backrest portion having a backrest material provided with a treatment member on front surface thereof;

a base portion provided at a lower portion of the seat portion;

at least one heater disposed independently from the base portion through a cable;

wherein the massaging machine further comprising:

a back pad which is provided so as to cover the front surface of the backrest material, the back pad having a first pad portion and a second pad portion separably joined by a zipper, wherein the second pad includes a receiving portion for receiving a heater or a locking portion for locking the heater, and wherein when the second pad portion is separated from the first pad portion, the second pad portion is configured to be placed at the front side of the backrest portion so as to cover at least shoulder of a person to be treated;

wherein the second pad portion has an opening portion, and the first pad portion is formed in a shape to be disposed in the opening portion formed in the second pad portion.

* * * * *